United States Patent [19]

Gerdeman

[11] 4,167,205

[45] Sep. 11, 1979

[54] INSULATING VALANCE

[76] Inventor: Dale B. Gerdeman, 1403 Fifth St., Las Vegas, N. Mex. 87701

[21] Appl. No.: 942,781

[22] Filed: Sep. 15, 1978

[51] Int. Cl.[2] ..... A47H 1/00

[52] U.S. Cl. ..... 160/330; 160/123

[58] Field of Search ..... 160/123, 124, 125, 126, 160/330; 126/270

[56] References Cited

U.S. PATENT DOCUMENTS

| | | | |
|---|---|---|---|
| 3,857,432 | 12/1974 | Russell | 160/124 |
| 3,990,635 | 11/1976 | Restle et al. | 126/270 |

*Primary Examiner*—Peter M. Caun

*Attorney, Agent, or Firm*—Walter R. Keller

[57] ABSTRACT

A pivotal baffle disposed above or behind drapes so as to define a closed chamber with the walls, windows and drapes when the drapes are drawn to their closed position; thereby preventing room air from circulating past the windows.

2 Claims, 4 Drawing Figures

INSULATING VALANCE

BACKGROUND

1. Field of the Invention

This invention relates broadly to conserving energy by preventing the rapid transmission of heat through windows, thereby assisting in maintaining a temperature level which is comfortable to humans within a room. More particularly this invention relates to closing off the natural air channel between windows and drapes and the creation of a dead air space when the drapes are drawn closed.

2. Description of Prior Art.

It is well known that windows are notorious dissipators of heat in homes and office buildings during cold weather. During hot weather much unwanted heat is introduced through window. Whenever the outside temperature is different than the room air temperature the window glass becomes a transmitter of heat, either inward or outward as the case may be. Nature is concerned with equalizing the temperature of the inside with that of the outside. Man attempts to maintain a human comfort temperature level in a room by the use of energy. In the normal drapery installation when the drapes are closed nature moves the room air convectively through the channel between the drapes and the window somewhat in the manner of air movement in a chimney, picking up heat from, or losing heat to the window glass as it moves.

The invention, along with properly installed, good quality, tight-fitting drapes impedes nature by closing the "chimney", and creating a dead air space in it's place. RESTLE, U.S. Pat. No. 3,990,635, 1976 recognized the problem of heat transfer through windows, and by using heat absorbing or reflecting sheets of material, utilized the heat incident thereon through the window or reflected the heat away. RESTLE utilizes a chamber with baffles at the top and bottom to control flow of air past the window.

SUMMARY

Up to forty-five percent of the heat transfer into or out of a conventionally built home or office building occurs through the windows. Drapes are commonly used especially with large windows or glass doors. Even through the opening is small at the top and bottom of the drapes when drawn, a chimney effect is created and the room air is channeled by convection forces past the window. In the winter time the warm room air loses it's heat to the cold glass and the heat is passed on to the outside. In the summer time the room air cooled by air conditioning circulates past warm windows bringing unwanted heat into the room. This invention briefly can be characterized as a pivotal baffle which defines a closed air chamber in collaboration with drawn drapes, thus preventing air circulation past the windows. Since the drapes must be drawable, the baffle is adjustable to an open position so that it will not interfere with the opening and closing of the drapes.

DESCRIPTION OF THE PREFERRED EMBODIMENT

Figure 1:
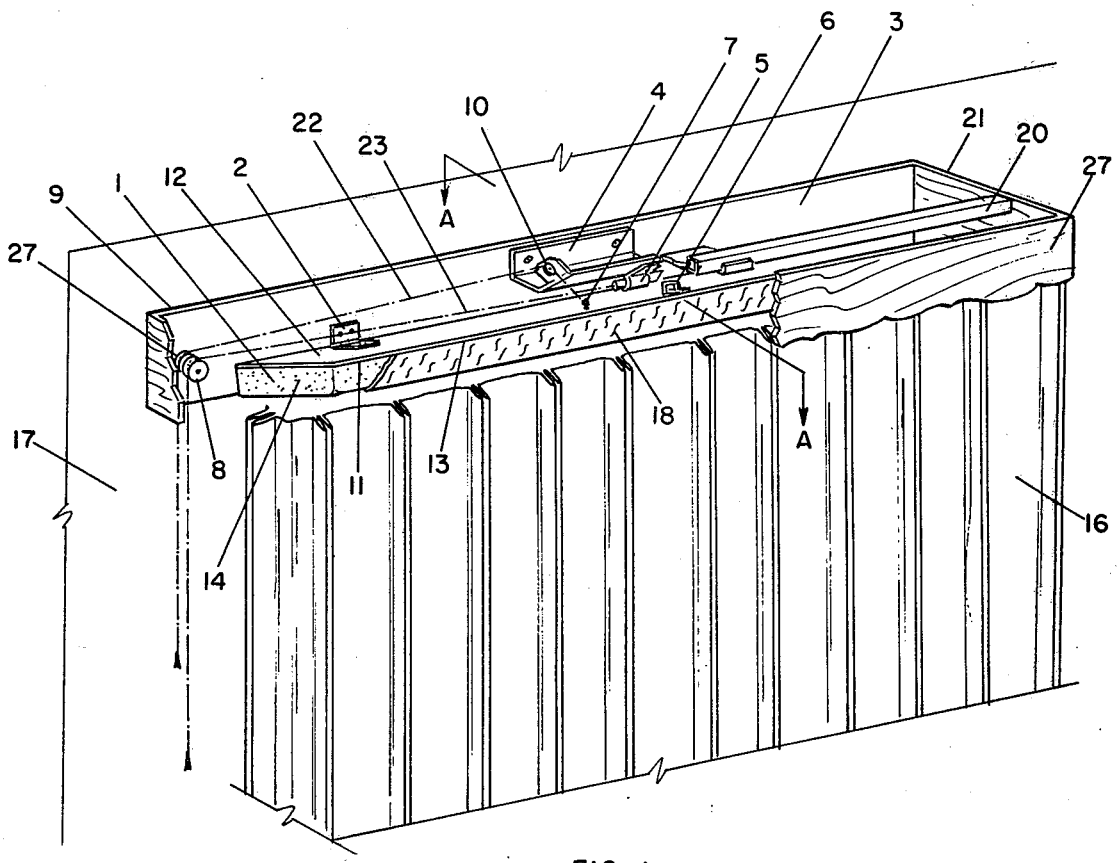
FIG. 1 is an isometric view of a traverse rod drapery installation with cutaway showing the installation of the invention, with baffle partially raised.
Figure 2:
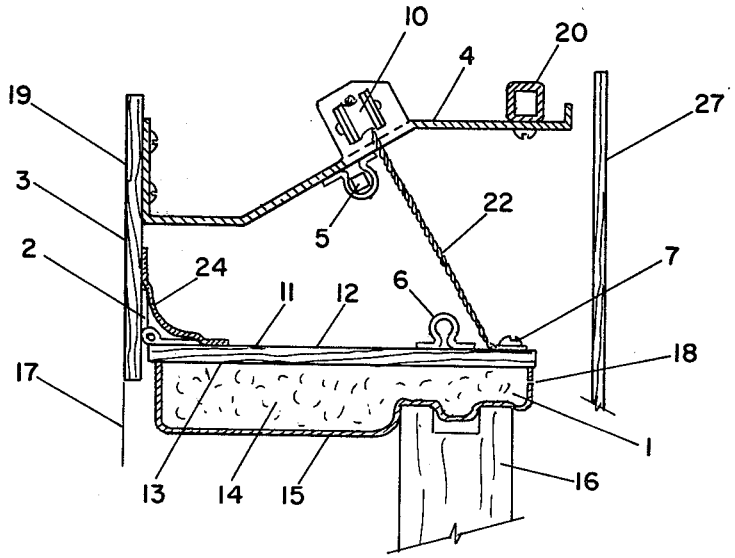
FIG. 2 is a sectional view cut on A—A of FIG. 1, with baffle lowered.

Referring to the drawings, FIGS. 1 and 2 shows the invention to have a baffle 1, a plurality of hinges 2, a frame 3, a mechanism bracket 4, a latch 5, a latch ring 6, a lift eye 7, a latch pulley 8, a baffle pulley 9, and a lift pulley 10. The baffle 1 consists of a rectangular baffle plate 11 having an upper surface 12, and lower surface 13. To the lower surface 13, batting 14 and batting cover 15 are attached. FIG. 1 shows a typical traverse rod installation with drapes 16 in the closed position hanging from a traverse rod, however, the travers rod is not shown. The invention is shown mounted to a wall 17 of a room. The baffle 1 is sized to cover the opening between the drapes 16 and the wall 17, thus closing the upper air passage between the wall 17 and drapes 16. The batting 14 covers the entire surface of the baffle plate 11, and the batting 14 consists of cotton, polyester, or other suitable soft material. The batting 14 should be over one inch thick. The batting cover 15 is a soft, thin plastic covering the batting 14 to keep the batting 14 from shedding, or causing lint problems, to contain the batting 14 in its proper place and to keep the batting 14 clean. The batting cover 15 has a plurality of slits 18, or perforations to permit air to pass from or into the batting 14 when the batting 14 expands or is compressed.

The frame 3 consists of a back longitudinal rail 19, a support bar 20, two end braces 21, and the mechanism bracket 4 is mounted in the frame 3 between the back longitudinal rail 19 and the support bar 20. The mechanism bracket 4 is mounted at approximately the mid-point of the length of the back longitudinal rail 19 and the support bar 20. The mechanism bracket 4 provides rigidity to the frame 3 and supports the latch 5 and lift pulley 10.

The baffle plate 11 is attached to the back longitudinal rail 19 by a plurality of hinges 2 in such a manner that the baffle 1 rests on the drapes 16, but may be raised off the drapes 16 when the drapes 16 are to be opened or closed. It is obvious that a number of hinges 2 is a function of the size and weight of the baffle 1. Attached to the upper surface 12 of the baffle plate 11 at approximately the mid-point of the length of the baffle plate 11, but toward the drapes 16 is the lift eye 7. The lift eye can be any means whereby a baffle cord 22 may be attached. Mounted on the mechanism bracket 4 is latch 5. Latch 5 is commonly called a barrel latch, chain latch, or transom latch and is of known construction. Mounted to the upper surface 12 is the latch ring 6. The latch ring 6 is located on the upper surface 12 of the baffle plate 11 so that when the baffle 1 is raised on its hinges 2 the latch ring 6 mateably engages the latch 5. Mounted on an end brace 21, are the latch pulley 8 and the baffle pulley 9. A baffle cord 22 is threaded over the baffle pulley 9, and over the lift pulley 10 and attached by tying to the lift eye 7; the baffle cord 22 being of such length that it may be easily grasped and pulled.

A latch cord 23 is attached to the latch 5, threaded over the latch pulley 8, and hanges down a length similar to the baffle cord 22. The latch cord 23 and the baffle cord 2 are of any convenient material, may be color coded, or decoratively made such as common drapery pull cord. In order to more effectively seal the opening, and to prevent air passage at the top of the drapes 16, a sealing strip 24 is affixed to the back longitudinal rail 19 and to the upper surface 12 of the baffle plate 11 along the entire length of the baffle plate 11. This sealing strip 24, made of thin plastic such as polyethelyne, is attached over the hinges as shown in FIG. 2, and is attached to the back longitudinal rail 19 and the baffle plate 11 in any convenient, but sealing manner such as by glueing.

The operation of the invention will now be described beginning with the drapes 16 open, and the baffle 1 raised. The operator first closes the drapes 16 in the conventional manner as is shown in FIG. 1. Once the drapes 16 are closed, the operator applies a downward pull on the latch cord 23, releasing the latch 5 and freeing the latch ring 6, and allowing the baffle 1 to be lowered by gravity on to the drapes 16 as shown in FIG. 2. In this position the invention forms a closed chamber with the drapes 16 and wall 17. To open the drapes 16, the operator first pulls downward on the baffle cord 22, the baffle 1 is raised on its hinges 2 and the latch ring 6 engages the latch 5 thereby securing the baffle 1 in the raised position, and freeing the drapes 16 for opening and closing in their normal manner. If baffle 1 is heavy it could be eased down by a force on baffle cord 22.

Figure 3:
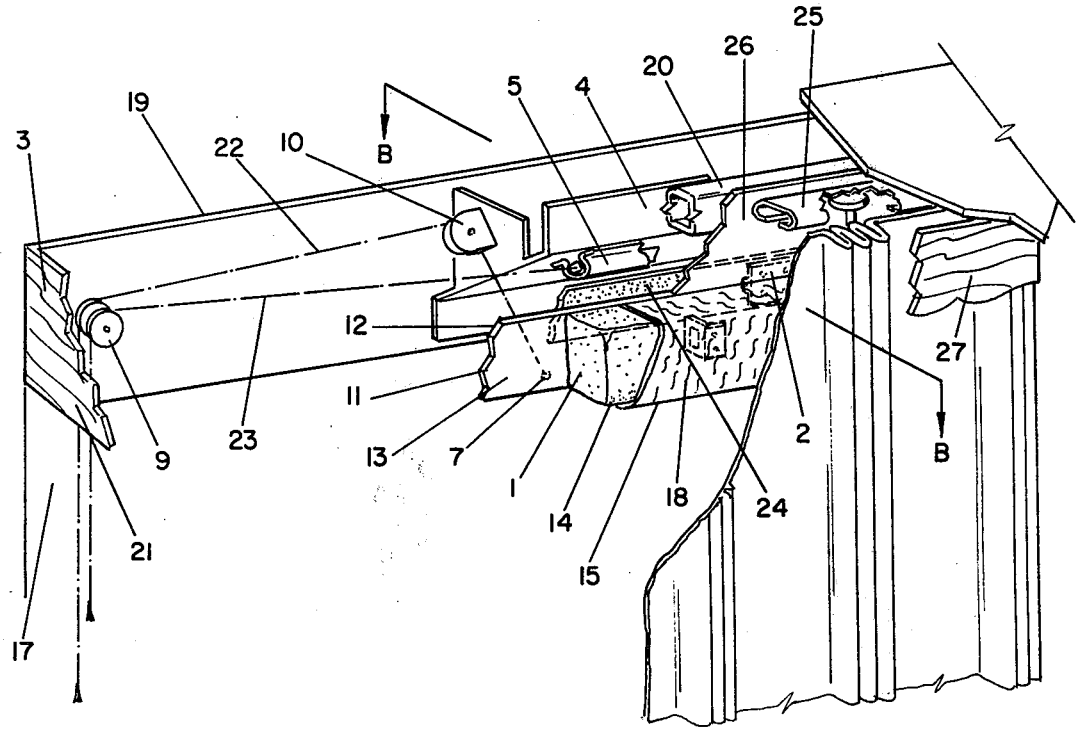
FIG. 3 is an isometric view of a ceiling track drapery installation with cutaway showing installation of the invention.
Figure 4:
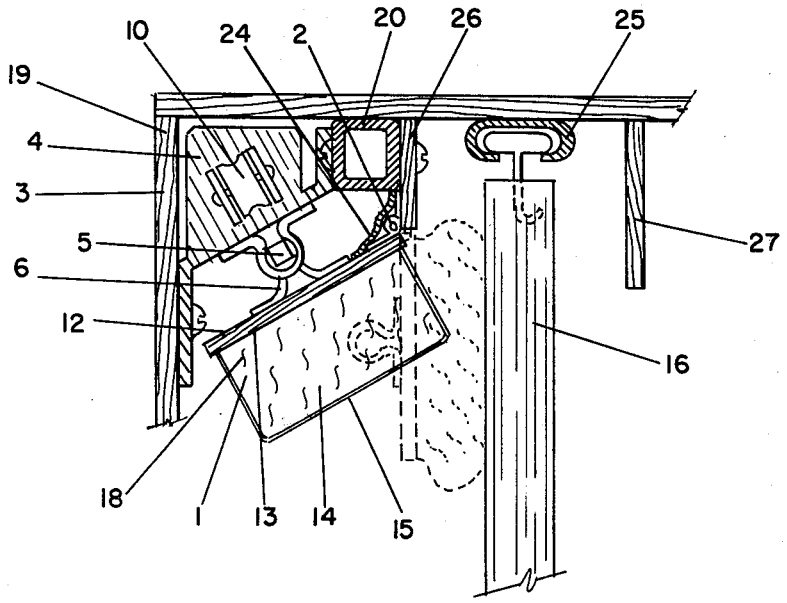
FIG. 4 is a sectional view cut on B—B of FIG. 3.

In some installation, the drapes 16 are installed and hang from ceiling track 25 as shown in FIG. 3. To accommodate this variation of the method of hanging drapes 16, the component parts of the invention must be simply rearranged. The invention seals against the side of the drapes 16 as shown in FIG. 4, instead of the top as previously described. As shown in FIG. 3, a hinge rail 26 is attached to the support bar 20. The baffle 1 is hinged to the hing rail 26 by the plurality of hinges 2 instead of the back longitudinal rail 19 so that it raises to the rearward, and in the lowered position, hanges vertically with the batting cover 15 and batting 14 sealing against the window side of the drapes 16 as shown in FIG. 4 instead of on top as shown in FIG. 2.

The operation of the invention is identical in either configuration. In either configuration it may be desireable to extend the end braces 21 in order to support a decorative, concealing valance 27 as shown in FIG. 1; however, this decorative valance 27 has only the function of decoration and concealment, and is not required by the invention.

I claim:

1. A device for forming a closed chamber with transverse rod hung drapes, and the wall of a room, to control the circulation of room air past windows, comprising:

a baffle having a baffle plate generally rectangular in shape with an upper surface and lower surface; batting and batting cover attached to and covering the lower surface of the baffle plate, and a latch ring and lift eye attached to the upper surface of the baffle plate at approximately mid-length of the baffle plate, the latch ring mounted thereon to mate with a latch; the baffle being mounted by a plurality of hinges to a frame consisting of a back longitudinal rail, two end braces, a support bar forming a rectangular frame having a mechanism bracket mounted to and between the back longitudinal rail and support bar at approximately the mid-length of the back longitudinal rail and support bar; and the mechanism bracket having mounted thereon a latch and a lift pulley, and latch mating with the latch ring, a latch pulley and a baffle pulley mounted on one of the end braces;

a latch cord, which attaches to the latch, is threaded over the latch pulley and hangs down free, a convenient length, a baffle cord which attaches to the lift eye, is threaded over the lift pulley, thence over the baffle pulley and hangs down free a convenient length, a sealing strip of thin plastic such as polyethelyne, affixed as by glueing to the back longitudinal rail, over the hinge, and to the upper surface of the baffle plate;

whereby an operator of the invention pulls on the latch cord to release the latch, and pulls or releases the baffle cord to raise and lower the baffle, and whereby the baffle in its raised position frees the drapes for opening and closing; and whereby the baffle in its lowered position engages the top of the drapes, forming a closed chamber with the wall and drapes.

2. The device of claim 1 wherein the drapes are hung on ceiling tracks instead of being wall mounted, and wherein the support bar supports a hinge rail and wherein the baffle is hinged to the hinge rail, instead of the back longitudinal rail, and wherein the sealing strip is attached to the hinge rail as by glueing, over the hinges and to the upper surface of the baffle plate, in such a manner that the baffle in its lowered position hangs vertically and the batting and batting cover engage the window side of the drapes thereby forming the closed chamber.

* * * * *